United States Patent [19]

Arendash

[11] 4,432,293

[45] Feb. 21, 1984

[54] VERTICAL AXIS ROTARY LOOP TAKER

[75] Inventor: Joseph M. Arendash, Cleveland, Ohio

[73] Assignee: White Consolidated Industries, Inc., Cleveland, Ohio

[21] Appl. No.: 452,929

[22] Filed: Dec. 27, 1982

Related U.S. Application Data

[63] Continuation of Ser. No. 205,197, Nov. 10, 1980, abandoned.

[51] Int. Cl.[3] ..... D05B 57/08; D05B 57/26

[52] U.S. Cl. ..... 112/231

[58] Field of Search ..... 112/181, 184, 191, 228, 112/229, 230, 231

[56] References Cited

U.S. PATENT DOCUMENTS

| | | | |
|---|---|---|---|
| 1,691,242 | 11/1928 | Greenwood | 112/184 |
| 1,989,594 | 1/1935 | Gonyk | 112/231 |
| 2,148,385 | 2/1939 | Waterman | 112/228 X |
| 2,655,885 | 10/1953 | Kostro | 112/231 X |
| 2,862,468 | 12/1958 | Johnson | 112/158 A |
| 4,108,095 | 8/1978 | Kohara | 112/184 |
| 4,292,906 | 10/1981 | Johnson | 112/231 X |

*Primary Examiner*—Wm. Carter Reynolds

*Attorney, Agent, or Firm*—Pearne, Gordon, Sessions, McCoy, Granger & Tilberry

[57] ABSTRACT

A non-rotatable, disc-like bobbin carrier is nested in a cup-shaped, vertical axis, rotary loop taker that slidably supports the bobbin carrier at its periphery on an annularly extending, discontinuous lip constituting a circular race slightly offset eccentrically from the loop taker axis of rotation. As the loop taker rotates, the eccentrically positioned bobbin carrier jogs back and forth in reciprocating fashion against one and then the other of a pair of diametrically opposed fixed stops that cooperate to preclude rotation of the bobbin carrier. The movement of the bobbin carrier away from and against each stop is synchronized with movement of a thread loop about the bobbin carrier to permit free passage of the loop between the fixed stops and the moving bobbin carrier. The lower end of an associated needle bar guide is pivotally retained for arcuate movement at the distal end of a link member having its fixed end located on the vertical axis of the loop taker to maintain the stitching needle a fixed radial distance from the adjacent arcuate section of the revolving loop taker hook for optimum stitching during zig-zag movements of the related needle bar.

14 Claims, 7 Drawing Figures

VERTICAL AXIS ROTARY LOOP TAKER

This is a continuation of application Ser. No. 205,197, filed Nov. 10, 1980, now abandoned.

BACKGROUND OF THE INVENTION

The present invention relates in general to sewing machines having vertical axis rotary loop taker assemblies, and, in particular, to a zig-zag sewing machine having a vertical axis rotary loop taker allowing free passage of a thread loop about a loop taker supported, non-rotatable bobbin carrier, and having an arcuately movable, pendulumlike needle bar guide for effecting zig-zag stitching movements of the associated reciprocating needle bar.

U.S. Pat. No. 2,862,468 to Johnson discloses a zig-zag sewing machine of the general type to which the present invention is directed. Such a sewing machine includes a continually rotating, cup-shaped loop taker coaxially supporting a non-rotating thread case or bobbin carrier, the axis of rotation of the loop taker being parallel to a vertically extending, reciprocating needle bar cooperating with the loop taker.

With particular reference to the drawings of the noted Johnson patent, a loop taker mechanism (see drawing FIGS. 33–45) includes a revolving beak portion 219 that draws a thread loop about an associated thread case 283 wherein the thread loop is forcibly pulled between the non-rotatable thread case 283 and a thread case stop in the illustrated form of the distal end of a restraining arm 322. Such movement of the thread loop about the thread case is discussed by Johnson in the section of his patent specification titled "Stitch Formation."

While frictionally impeded movement of thread loops about a non-rotational thread case or bobbin carrier, between a stop and the bobbin carrier, in the manner taught by Johnson may provide suitable loop stitching, it has been recognized by those skilled in the art that unimpeded free movement of the thread loop about the bobbin carrier is more desirable since frictional wear-and-tear on the thread loop would be lessened.

U.S. Pat. No. 4,108,095 to Kohara provides a loop taker assembly having an opposed pair of movable stops which alternately impede the rotation of an associated bobbin carrier mounted coaxially upon and supported by a continually rotating loop taker. While the vertical axis rotary loop taker assembly of Kohara does preclude the necessity of forcing the thread loop between the bobbin carrier and one or more stops continuously engaging the bobbin carrier, the resultant mechanism is undesirably complex and costly to manufacture.

With further reference to U.S. Pat. No. 2,862,468 to Johnson, in drawing FIG. 19 and in lines 49–72 of column 13 of his specification, Johnson teaches the desirablility of having his stitch needle arcuately track the adjacent arcuate sector of the revolving loop taker hook path during zig-zag transverse movement of the stitch needle. The needle bar guide mechanism provided by Johnson to effect such arcuate stitch needle movement includes a pair of ball-and-socket universal joints 124, 188. Such joints are relatively expensive to manufacture and may easily become fouled with dirt over a period of time, since their bearing surfaces open outwardly and upwardly wherein settling airborne dust can readily enter.

SUMMARY OF THE INVENTION

A sewing machine having a vertically extending needle bar is provided with a loop taker mechanism including a rotatably driven loop taker having an axis of rotation generally parallel to the vertically extending needle bar. In accordance with the present invention, the loop taker includes an eccentric drive portion spaced from and revolving about the loop taker axis of rotation as the loop taker rotates. A pair of spaced stop members generally fixed in position are provided relative to the loop taker axis of rotation. A non-rotatable bobbin carrier driven by the eccentric drive portion for reciprocating movement into engagement against one and then the other of the stop members is supported by the loop taker, the stop members cooperating to preclude rotation of the bobbin carrier. The bobbin carrier alternately disengages from one and then the other of the stops to permit free passage of the thread loop about the bobbin carrier, at least one or the other of the stops always engaging the bobbin carrier when the loop taker is rotating.

In a preferred form, the rotatably driven loop taker comprises a casing having a discontinuous, annularly extending surface constituting a discontinuous circular race extending about the casing axis of rotation, the center of the circular race being eccentrically offset from the casing axis of rotation to comprise the eccentric drive means. A pair of diametrically opposed stop members generally fixed in position relative to the loop taker axis of rotation bracket the loop taker axis of rotation wherein the distance between each stop member and the axis of rotation is equal. The bobbin carrier is provided in the form of a disc-like member providing a circularly extending periphery slidably supported by the circular race of the loop taker casing, the casing being cup-shaped with the disc-like bobbin carrier nested in and spaced from the bottom thereof.

In further accordance with the invention, a zig-zag sewing machine having a vertical axis rotary loop taker, and a vertically extending needle bar driven for reciprocating movement along its longitudinal axis, is provided with a pendulumlike needle bar guide assembly permitting arcuate movement of the stitch needle during the zig-zag motion thereof. The needle bar guide assembly includes a vertically extending yoke member providing an upper bushing means and a lower bushing means for slidably receiving the reciprocating needle bar. A universal joint means constituted by at least two pin joints for pivotally supporting the top end of the yoke member in a fixed position relative to the vertical axis of the loop taker is provided. The universal joint means permits generally orbital movement of the lower end of the yoke member. A link member having its distal end connected to the lower end of the yoke member and its fixed end positioned on the vertically extending axis of the loop taker is provided to limit to a predetermined arcuate path the movement of the lower end of the bottom section of the yoke member during transverse, zig-zag movement of the reciprocating needle bar.

The rotary loop taker assembly and the needle bar guide of the present invention minimize wear and tear on thread loops while providing for consistent and accurate zig-zag stitching.

A fuller understanding of the invention may be had by referring to the following description and claims, taken in conjunction with the accompanying drawings.

DETAILED DESCRIPTION OF THE PREFERRED EMBODIMENT

Figure 1:
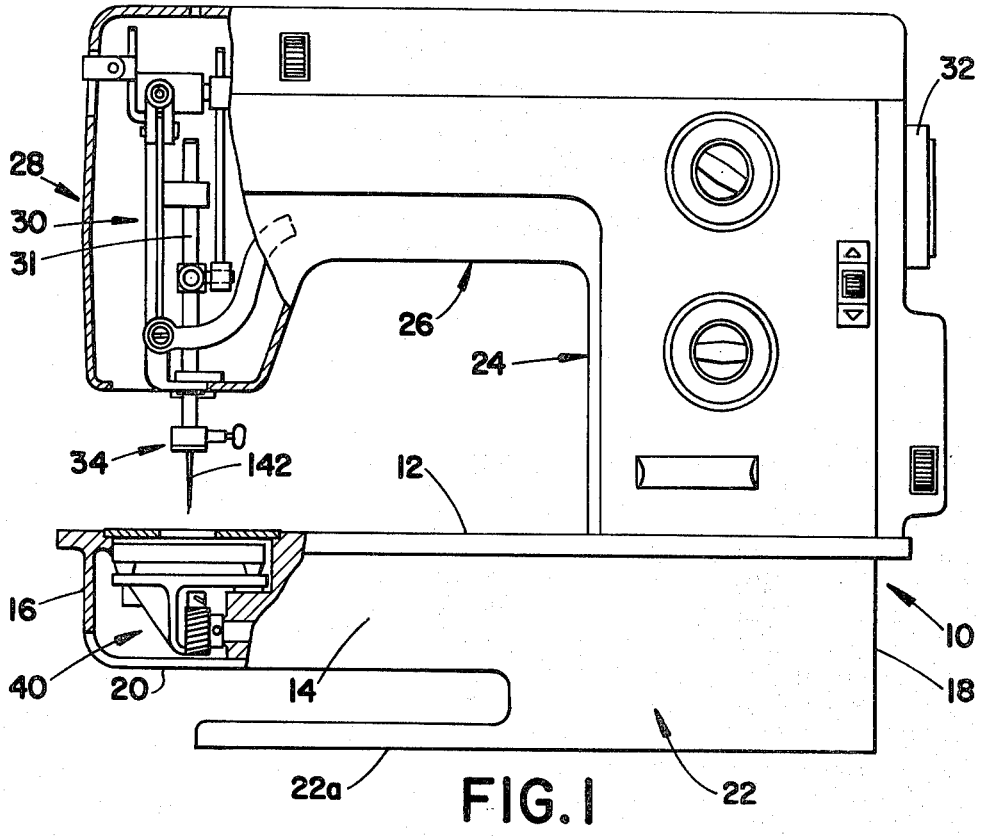
FIG. 1 is an elevational view of a conventionally configured upright, open-arm sewing machine, with sections cut away to reveal a rotary loop taker assembly and needle bar guide assembly in accordance with the present invention.

With reference to FIG. 1, there is illustrated an upright, open arm, zig-zag sewing machine of conventional geometry, such machine including a rectangle-shaped base 10 having an upper work-supporting surface or bed plate 12, a pair of downwardly extending sidewalls 14 (only one shown), a downwardly extending forward wall 16, and a downwardly extending rear wall 18. A bottom wall 20, parallel to and spaced below the bed plate 12, cooperates with the bed plate 12 and the walls 14, 16, and 18 to define a longitudinally extending interior volume of rectangular cross section within which is mounted a vertical axis, rotary loop taker mechanism 40 in accordance with the present invention and a conventional reciprocating feed dog mechanism (not shown) for feeding web material, such as cloth to be stitched, across the bed plate 12, between a needle assembly 34 and the rotary loop taker mechanism 40. The rectangle-shaped base 10 is supported in a conventional manner on a pedestal 22, from which extends a foot portion 22*a*.

Extending upwardly from one end of the rectangular base 10, such as the right-hand end of the base 10 as viewed in FIG. 1, is a hollow standard 24 which, in a conventional manner, contains a sewing machine drive motor, an associated motion transmission means for driving moving sewing machine elements, and numerous control means for varying the characteristics of such motion transmission. A conventional hand wheel 32 is also provided, and serves in a conventional manner to permit manual movement of the rotary loop taker mechanism 40 and other related sewing machine elements. Extending horizontally leftward (as viewed in FIG. 1) from the upper portion of the standard 24 is an overhanging bracket arm 26 which extends out over the bed plate 12 in a conventional manner to provide, within a hollow head portion 28, a needle bar guide assembly 30 that controls the zig-zag positioning of a reciprocating needle bar 31 terminating at its lower end in the needle assembly 34. It is to be noted that a conventional presser bar mechanism cooperating with the needle assembly 34 is not shown, but it is to be recognized by those skilled in the art that such would normally be provided.

Figure 2:
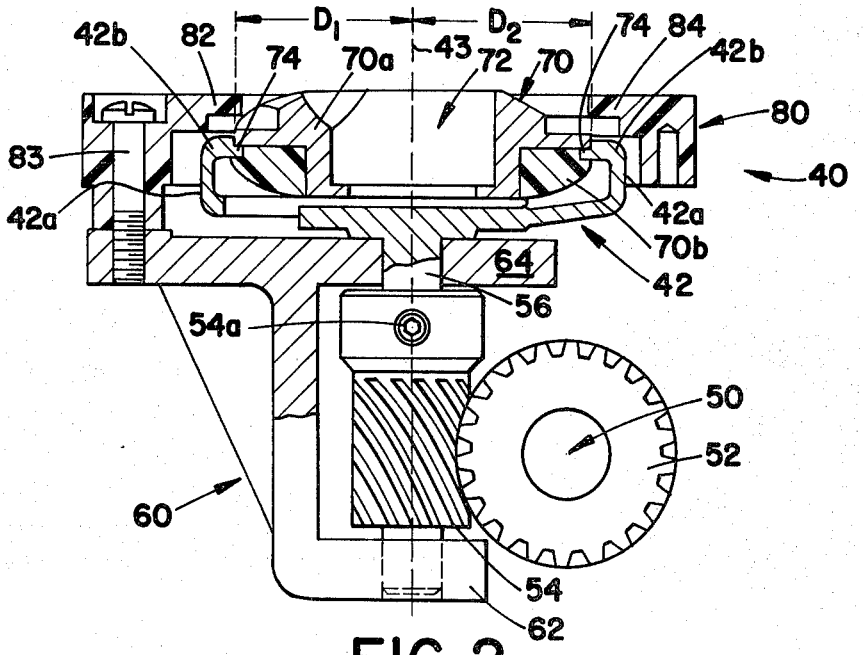
FIG. 2 is a cross-sectional view of the vertical axis rotary loop taker illustrated in FIG. 1.

Turning to FIG. 2, there is illustrated a cross-sectional view of the vertical axis rotary loop taker mechanism 40 in accordance with the present invention. A rotatably driven loop taker in a preferred form of a cup-shaped casing 42 rotates on a vertical axis 43 extending generally parallel to the longitudinal axis of the generally vertically extending needle bar 31 (see FIG. 1). The cup-shaped rotary loop taker casing 42 is coaxially mounted relative to axis 43 at its bottom central portion on the top of a rotatable shaft 56 having its upper end journaled within a bushing-type aperture in an upper, horizontally extending leg 64 of a loop taker support frame 60 and its lower end supported by and journaled within a bushing-type aperture in a lower horizontally extending leg 62 of the support frame 60, the legs 62, 64 being parallel to each other, the support frame 60 in turn being fastened to the lower wall 20 (see FIG. 1) in a suitable fashion.

A helical driven gear 54 is positioned on the central portion of the shaft 56, as illustrated, between the lower leg 62 and the upper leg 64 of the support frame 60, and is locked onto the rotatable shaft 56 by suitable means, such as a setscrew 54*a*. A helical drive gear 52, functioning for example as a worm gear, rotates on a horizontal axis 50 and rotatably engages the driven gear 54 to rotate it on its vertical axis coincident to the vertical loop taker axis 43. The gear driving configuration of the shaft 56 and the gears 54,52 is conventional in nature and well known in the art, and need not be explained in further detail.

The cup-shaped loop taker casing 42 includes an upwardly extending, circular sidewall 42*a* equidistantly spaced at all points from the axis 43 and having at its upper end an inwardly, radially projecting flange 42*b* providing an annularly extending bobbin carrier support lip portion 74. While the sidewall 42*a* is equidistantly spaced at all points from the loop taker axis of rotation 43, the annularly extending lip portion 74 is eccentrically offset to a slight degree relative to axis 43 wherein, at an eccentric rotational position as illustrated in FIG. 2, a radial distance $D_1$ extending for example from the left portion of the lip 74 to the axis 43 is not equal to a radial distance $D_2$ extending from the right portion of the lip portion 74 to the axis 43. It can be seen that the lip portion 74 as viewed in FIG. 2 will, when the casing 42 is rotating, move right and left relative to the axis 43, i.e., it will jog back and forth relative to the axis 43 to constitute an eccentric drive portion in the preferred form of a circular race upon which is supported a non-rotatable thread case or bobbin carrier 70 nested within the cup-shaped case 42.

The bobbin carrier 70 is illustrated in a preferred form as a disc-like member comprised of an upper portion 70*a* (including a bobbin thread recess 72) having a lower, downwardly projecting, cylindrical center portion received in a central aperture provided by a ringlike lower portion 70*b*, which mates with and engages the upper bobbin carrier portion 70*a*. The disc-like bobbin carrier 70 is spaced above the bottom portion of the cup-shaped loop taker casing 42 to permit passage of the thread loop around the bobbin carrier in a manner to be subsequently detailed.

Figure 6:
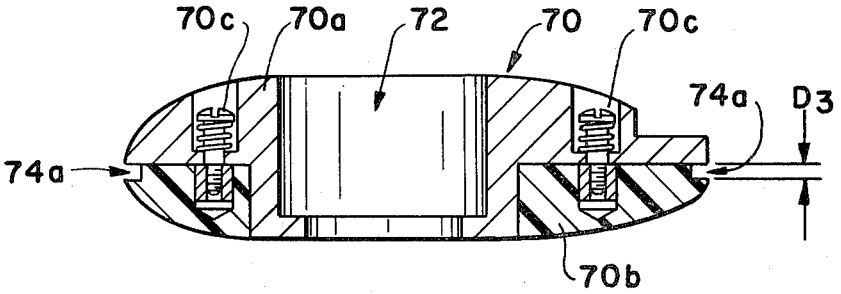
FIG. 6 is a cross-sectional view along line 6—6 of FIG. 4, illustrating the elements comprising a preferred disc-like bobbin carrier in accordance with the present invention.

With reference to FIG. 6, a separate cross section of the bobbin carrier 70 is illustrated, wherein the upper portion 70*a* and the lower portion 70*b* are seen to be held together by a pair of spring-biasing screw assemblies 70*c* which serve in a known manner to bias the portions 70*a*, 70*b* against each other as illustrated. The outer peripheral edge of the bobbin carrier 70 includes a support race receiving groove or slot 74*a* which is circular and extends circumferentially about the periphery of bobbin carrier 70. The slot 74*a* is illustrated in FIG. 6 as a rectangular, outwardly opening cross section area having a top wall defined by the periphery of the upper bobbin carrier portion 70*a* and an inner wall and a lower wall defined by the periphery of the bobbin carrier lower portion 70*b*. Since the upper portion 70*a* and the lower portion 70*b* are spring-biased relative to each other by the spring-biasing screw assemblies 70*c*, the groove width $D_3$ of the groove 74*a* can vary somewhat.

Returning to FIG. 2, it can be seen that the circular race 74 is received within the bobbin carrier-provided slot 74*a* (FIG. 6), wherein the circular race 74 slidably supports the bobbin carrier 70 at its periphery. In effect, the upper and lower portions 70*a*, 70*b* of the bobbin carrier, being spring-biased against each other, sandwich the race 74 between them at their peripheries and engage it in a slidable fashion at a predetermined degree of friction.

It can be seen that rotation of the drive gear 52 engaged with the driven gear 54 will cause rotation of the cup-shaped casing 42 on the vertical axis 43 while the eccentrically positioned bobbin carrier 70 would revolve in an eccentric manner about the axis 43. To prevent simultaneous rotation of the bobbin carrier 70 slidably supported by the rotating cup-shaped loop taker casing 42, a pair of generally diametrically opposed stops 82, 84 are spaced apart to a degree less than the maximum diameter of the cup-shaped loop taker casing 42 wherein the stops overhang both the disc-like bobbin carrier 70 and the associated loop taker casing 42 in a manner as illustrated in FIG. 2. The stops 82, 84 bracket the loop taker axis of rotation 43, the distance between each stop 82, 84 and the axis 43 being equal. The stops 82, 84 are provided, for example, by a stop plate 80 fastened to the support frame 60 by a plurality of screws 83 (only one shown) which serve to fix the stops 82, 84 in position relative to the axis 43.

In a manner to be subsequently explained with regard to FIGS. 3, 4, and 5, the stops 82, 84 alternately engage projecting shoulder portions of the bobbin carrier as the cup-shaped loop taker casing 42 rotates, wherein the bobbin carrier does not rotate. Rather, the bobbin carrier 70 as viewed in FIG. 2 will jog with pivotal movement from left to right to alternately engage the stops 82, 84 to permit free passage of a thread loop about the bobbin carrier 70.

Figure 3:
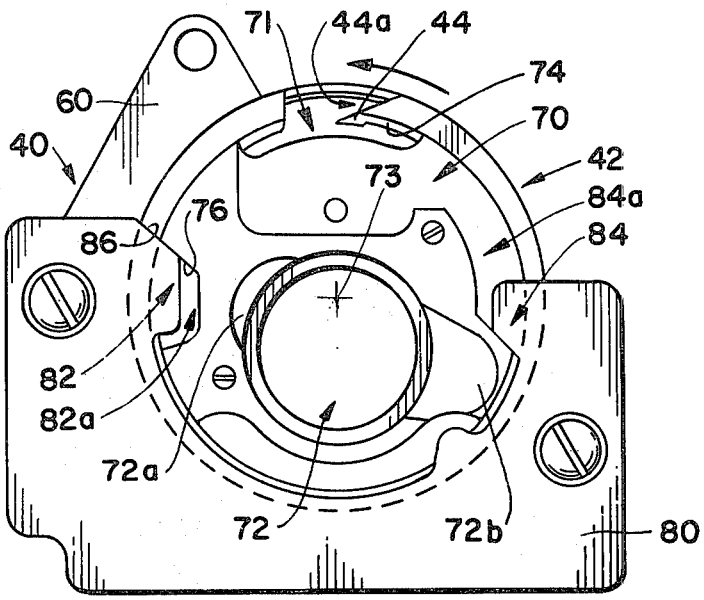
FIG. 3 is a plan view of the loop taker mechanism, wherein the hook or beak portion of the loop taker is at a loop taking position during its normal counterclockwise rotation.

With reference to FIG. 3, there is illustrated in plan view the cup-shaped loop taker casing 42, the bobbin carrier 70 nested within and slidably mounted thereon, and the stop plate 80 with stops 82, 84 that cooperate to preclude rotation of the bobbin carrier 70 as the loop taker casing 42 rotates. The loop taker casing 42 is illustrated as including a conventional loop-seizing beak or hook 44 defined in part by a cutout loop-receiving throat area 44*a*, the cutout area 44*a* resulting in the bobbin carrier support race 74 being discontinuous for a short portion of its circular extent. At a loop seizing position illustrated in FIG. 3, a reciprocating needle 142 (see FIG. 1) projects into and out of the cutout area 44*a* of the loop taker casing 42. Adjacent to such area of needle projection is a cutaway area 71 of the bobbin carrier which, like the cutout portion 44*a* relative to the lip 74, serves to make the race-engaging groove 74*a* (see FIG. 6) discontinuous for a short portion of its circular extent.

In FIG. 3, the center 73 of the disc-like bobbin carrier 70 lies superimposed on the axis of rotation 43 of the loop taker casing 42. The loop taker casing 42 and its associated hook 44 is rotationally positioned at a loop seizing station, that is, the hook portion 44 lies near the longitudinal axis of the reciprocating needle 142. At this position, as illustrated in FIG. 3, the eccentrically positioned bobbin carrier 70 engages both stops 82 and 84, as illustrated, the stops being received into recesses 82*a* and 84*a* defined in part by raised shoulder surfaces 76, 78 (see FIGS. 4 and 5) on the upper surface of the bobbin carrier 70, the stop precluding counterclockwise rotation of the bobbin carrier 70 as the loop taker case 42 is rotationally driven in a counterclockwise direction. Such upper surface of the bobbin carrier 70 includes the conventional bobbin spool receiving circular recess 72 with conventional depression areas 72*a* and 72*b* adapted to receive the user's fingers for ready removal of a spent bobbin thread spool.

Figure 4:
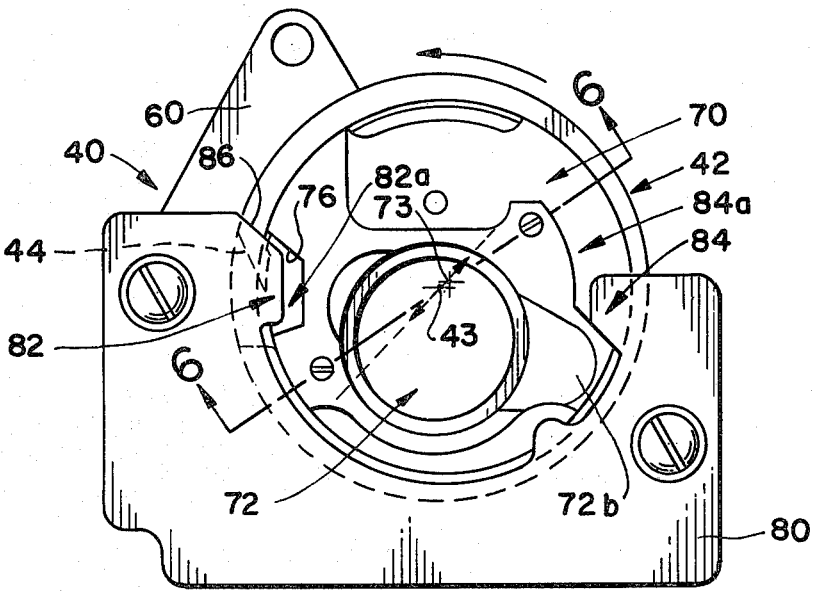
FIG. 4 is a plan view of the loop taker mechanism illustrated in FIG. 3, wherein the loop taker hook is moved counterclockwise, taking with it a thread loop for movement about the bobbin carrier.

Turning to FIG. 4, the assembly of FIG. 3 is again shown, wherein the loop taker hook 44 has rotated about 45 degrees in a counterclockwise direction and, in a conventional manner, carries a hooked thread loop having an upper portion which will ride on the upper surface of the bobbin carrier 70 and a lower portion which will ride on the lower surface of the bobbin carrier assembly, such thread loop movement being well known in the art.

It can be seen that the eccentricity of the circular race 74 supporting the bobbin carrier 70 will drive such bobbin carrier rightwardly toward the stop 84, wherein the bobbin carrier will slightly pivot about the stop 84 in a clockwise direction. It can further be seen that the center 73 of the bobbin carrier 70 will shift toward, for example, a two o'clock position as viewed in FIG. 4, and move slightly off the axis of rotation 43 of the rotating loop taker case 42. When in this position, the shoulder surface 76 constituting a first bobbin carrier movable stop is spaced slightly away from a fixed stop surface 86 provided by the stop 82, wherein the thread loop pulled by the hook 44 can pass unimpeded between the fixed stop surface 86 and the movable stop surface 76.

As the hook-seized loop continues in a counterclockwise direction about the bobbin carrier, the center 73 of the bobbin carrier 70 will move back to a position on the axis of rotation 43 of the loop taker casing 42, wherein the bobbin carrier returns to its position illustrated in FIG. 3, with both stops 82, 84 engaging the bobbin carrier 70. At this point, the hook 44 of the loop taker casing 42 has rotated approximatey 180 degrees counterclockwise from the position illustrated in FIG. 3.

Figure 5:
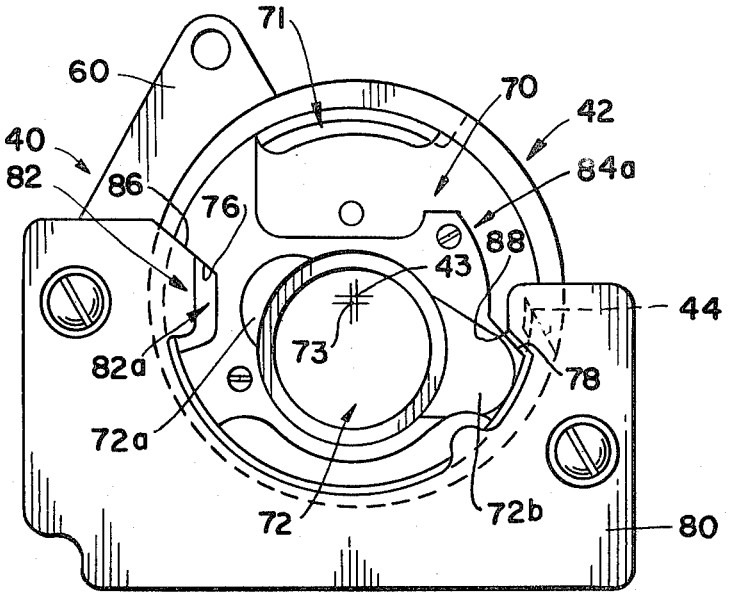
FIG. 5 is a plan view of the loop taker mechanism wherein the thread loop has moved about the bobbin carrier in a counterclockwise direction to a thread loop throw-off position wherein the thread loop is pulled from the loop taker hook for formation of the loop stitch in a conventional manner.

Turning to FIG. 5, the effect of continued counterclockwise rotation of the loop taker hook is illustrated. It can be seen that the hook 44 has now moved through a position where it has rotated counterclockwise through approximately 315 degrees. At such a position, the eccentrically positioned bobbin carrier 70 has moved toward and engaged the stop 82 and has slightly pivoted about the stop 82 in a clockwise direction, thereby pulling the shoulder surface 78 constituting a second bobbin carrier movable stop away from a fixed stop surface 88 provided by stop 84, wherein free passage of the thread loop between such surfaces can occur.

It is recognized in the art that at some point in this sector of the hook rotation, the thread loop slips off the hook 44 and is pulled by the needle 142 to form a loop stitch. It can further be seen that the center 73 of the bobbin carrier has shifted toward an eight o'clock position, slightly offset from the loop taker axis of rotation 43, as illustrated in FIG. 5. On continued rotation of the hook 44, which now does not have a thread loop entrained upon it, the bobbin carrier will shift back towards the position illustrated in FIG. 3, whereupon the cycle as discussed with regard to FIGS. 3, 4, and 5 is repeated.

It can be seen that rotation of the loop taker casing 42 relative to the non-rotatable, eccentrically positioned bobbin carrier 70 causes reciprocating planar movement or jogging of the bobbin carrier against one and then the other of the fixed stops 82, 84, such jogging movement of the bobbin carrier causing sequential opening and closing of the spaces between the respective pairs of stop surfaces 76, 86 and 78, 88, at least one or the other of the stops 82, 84 always engaging the bobbin carrier when the loop taker is rotating. It can be seen that the bobbin carrier planar movement is in a plane perpendicular to the axis of rotation 43 of the rotating loop taker. In effect, the surfaces 86 and 88 act as fixed cam surfaces lying along parallel lines spaced from the loop taker axis of rotation 43 which lies between such parallel lines, with the surfaces 76 and 78 constituting movable cam followers effecting slight pivotal movement of the non-rotatable bobbin carrier 70, as discussed earlier, to permit frictionally unimpeded free passage of the thread loop about the bobbin carrier 70.

Figure 7:
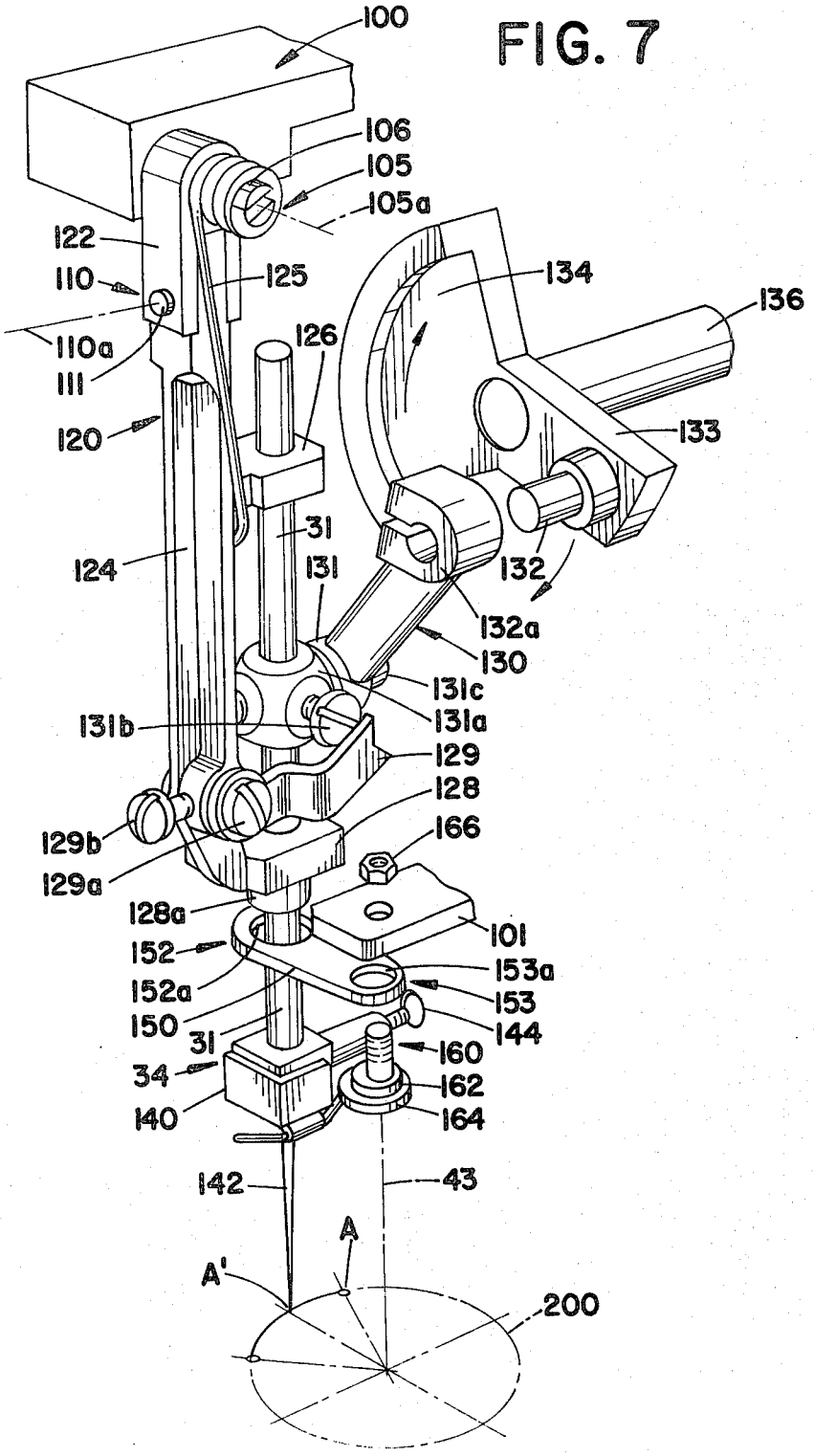
FIG. 7 is a partially exploded view in perspective of a needle bar guide assembly in accordance with the present invention.

In further accordance with the present invention, and with reference to FIG. 7, there is disclosed in greater detail the pendulumlike needle bar guide assembly 30 for supporting the vertically extending needle bar 31 driven for reciprocating movement along its longitudinal axis in relation to the vertical axis 43 of the rotary loop taker of a zig-zag sewing machine.

An upper frame portion 100 of the sewing machine supports a needle bar guide yoke 120 at its upper end, the yoke 120 hanging downwardly from the frame portion 100 to swing in pendulumlike fashion. The needle bar guide yoke 120 includes an upper yoke section 122 of short longitudinal extent and a lower yoke section 124 generally of a length substantially greater than the upper yoke section 122. The upper end of the upper yoke section 122 is pivotally connected to the frame portion 100 by a first pin joint 105 for pivotal movement in a fixed vertical plane on a first horizontal axis **105*a* provided by an appropriate first pivot pin 106 screwed into the frame portion 100. The lower end of the upper yoke section 122 is pivotally joined to the upper end of the lower yoke section 124 by a second pin joint 110 provided by a second pivot pin 111 extending along a second horizontal axis 110*a* that extends in a direction perpendicular to the first pivotal axis 105*a* provided by the first pivot pin 106. The two pin joints 105, 110 constitute a universal type joint generally fixing the top portion of the yoke 120 in position relative to the vertical axis 43 of the loop taker, wherein generally orbital movement of the lower end of the lower yoke section 124 is permitted. Extending generally horizontally outward from one side of the lower yoke section 124 is an upper sleevelike bushing 126 and a lower sleevelike bushing 128, the bushings 126, 128 being parallel to each other and axially aligned to slidably receive the reciprocating needle bar 31, swinging movement of the lower yoke section 124 in turn moving the longitudinal axis along which the needle bar 31** reciprocates.

Reciprocating movement of the needle bar 31 is provided by a conventional axially fixed, rotating drive shaft 136 having a crank arm 133 extending radially from its end to provide a crank pin 132 eccentrically positioned relative to the rotational axis of the shaft 136 and extending parallel to it. An appropriate counterweight 134 is provided diametrically opposite the crank pin 132, such counterweight configuration being well known in the art. A reciprocating drive arm 130 has one end providing a crank pin receiving bushing **132*a*, wherein upon rotation of the shaft 136, the drive arm 130 reciprocates as the eccentrically positioned crank pin 132 revolves about the axis of rotation of the shaft 136. The other end of the crank arm 130 provides a needle bar driving bushing 131 generally of the type of structure illustrated by bushing 132*a*, the bushing 131 receiving one end of a pin 131*c* whose other end is received in a universal ball and socket type joint 131*a* axially fixed in position on the needle bar 31, as illustrated. An adjustment screw 131*b* permits movement of the universal type joint 131*a* relative to the needle bar 31 to adjust the range of needle reciprocating movement. The universal type joint 131*a* permits the shaft 131*c* to slide axially in and out of the bushing 131 as the needle bar guide yoke pivotally swings in pendulum fashion back and forth on the axis 105*a* during zig-zag stitch movement of the needle bar 31. Such zig-zag movement of the needle bar is provided by a control pull arm 129 which is pivotally fixed to the lower end of the lower yoke section 124 by a screw 129*a* held in rotational position by a lock screw 129*b***.

To limit the degree of orbital swinging movement of the pendulumlike yoke member 120 to an arcuate path, a link member 150, positioned above the loop taker mechanism 40 (see FIG. 1) and movable in a fixed horizontal plane, is provided. The link member has a fixed end 153 and a distal end 152. A lower sewing machine frame portion 101 fixed in position relative to the upper frame portion 100 and the vertical loop taker axis 43 is provided generally along or adjacent to the loop taker axis. A pivot providing screw 160 having an eccentric bearinglike shoulder portion 162 and a head portion 164 serves to rotationally fasten and journal the fixed end 153 of the link 150 via an aperture **153*a*. The pivot providing screw 160 is fixed relative to the frame portion 101 by a suitable nut 166, as illustrated. The shoulder portion 162 of the screw 160 is offset eccentrically to a slight degree from the axis of rotation of the loop taker to permit positional adjustment of the link member 150. It can be seen that the effective straight line distance between the axis 43 and the longitudinal axis of the needle bar 31 is varied to a slight degree by rotation of the screw 160. The distal end 152 of the link member 150 includes a guide bar receiving bushing 152*a* which slidably receives a collar portion 128*a* extending downwardly from the lower part of the lower needle bar guide bushing 128 which slidably receives the needle bar 31**.

Extending from the lower end of the needle bar 31 is the needle assembly 34 including a stitch needle retainer 140 for holding the stitch needle 142 whose distal point end cooperates with the loop taker hook 44 (see FIG. 3). Upon translational movement of the control member 129, the needle bar guide yoke 120 is pulled counterclockwise (as seen in FIG. 7) pivotally about the pin 106, wherein the distal point end of the needle 142 will arcuately move from a location A' to a location A on the loop taker revolution path 200. Because of the link member 150, the needle tip or point will follow a generally arcuate path between points A' and A to arcuately track on the adjacent sector of the loop taker hook. It can be seen that such action is accomplished by the combined pivotal action on pins 106 and 111. Upon release of the control arm 129, a biasing spring 125 will force the needle bar back to its normal position as illustrated in FIG. 7. During high speed zig-zag stitching, the point end of the needle 142 reciprocates to and from the position A' while also reciprocating up and down on its longitudinal axis.

It can be seen that the needle bar mechanism illustrated in FIG. 7 advantageously provides, in a relatively simple manner, a zig-zag sewing machine needle bar guide that permits arcuate tracking of the revolving loop taker path sector adjacent the needle without requiring complex ball-and-socket type bearings or other such mechanisms as heretofore utilized in the prior art.

Although the preferred embodiments of this invention have been shown and described, it should be understood that various modifications and rearrangements of parts may be resorted to without departing from the scope of the invention as disclosed and claimed herein.

What is claimed is:

1. In a sewing machine having a vertically extending needle bar, a loop taker mechanism comprising:

a rotatably driven loop taker having an axis of rotation generally parallel to the vertically extending needle bar, the loop taker including an eccentric drive portion spaced from and revolving about the loop taker axis of rotation as the loop taker rotates;

a pair of spaced stop members generally fixed in position relative to the loop taker axis of rotation; and a non-rotatable bobbin carrier driven by said eccentric drive portion for reciprocating planar movement into engagement against one and then the other of the fixed stops, the stops cooperating to preclude rotation of the bobbin carrier, the bobbin carrier alternately disengaging from one and then the other of the stops to permit free passage of a thread loop about the bobbin carrier, at least one or the other of the stops always engaging the bobbin carrier when the loop taker is rotating, the bobbin carrier planar movement being in a plane perpendicular to said axis of rotation.

2. A loop taker mechanism according to claim 1, wherein the stops are diametrically opposed from each other relative to the loop taker axis of rotation.

3. A loop taker mechanism according to claim 1, wherein the eccentric drive portion continuously engages the bobbin carrier during rotation of the loop taker.

4. A loop taker mechanism according to claim 3, wherein the non-rotatable bobbin carrier moves generally continuously during rotation of the loop taker.

5. In a sewing machine having a vertically extending needle bar, a loop taker mechanism comprising:

a rotatably driven loop taker casing having an axis of rotation generally parallel to the vertically extending needle bar, the casing providing a discontinuous annularly extending surface constituting a discontinuous circular race extending about the casing axis of rotation, the center of the circular race being eccentrically offset from the casing axis of rotation;

a pair of diametrically opposed stop members generally fixed in position relative to the loop taker axis of rotation, the stop members bracketing the loop taker axis of rotation, the distance between each stop member and said axis being equal;

a non-rotatable bobbin carrier slidably supported on the eccentrically offset circular race, rotation of the loop taker casing relative to the non-rotatable eccentrically positioned bobbin carrier causing reciprocating planar movement of the bobbin carrier into engagement against one and then the other of the fixed stops, the stops cooperating to preclude rotation of the bobbin carrier, the bobbin carrier alternately disengaging from one and then the other of the stops to permit free passage of a thread loop about the bobbin carrier between the stops and the bobbin carrier, at least one or the other of the stops always engaging the bobbin carrier when the loop taker casing is rotating, the bobbin carrier planar movement being in a plane perpendicular to said axis of rotation.

6. A loop taker mechanism according to claim 5, wherein the bobbin carrier is disc-like and provides a circularly extending periphery slidably supported by said circular race, said casing being cup-shaped and having an upper lip portion, the circular race being constituted by the upper lip portion of the cup-shaped casing, the bobbin carrier being nested within and spaced from the botton of the cup-shaped casing.

7. A loop taker mechanism according to claim 6, wherein said lip portion is slidably received within and projects into a discontinuous slot about the circularly extending periphery of the disc-like bobbin casing.

8. A loop taker mechanism according to claim 7, wherein the bobbin carrier is retained in nested position within the loop taker casing.

9. In a sewing machine having a vertically extending needle bar, a loop taker mechanism comprising:

a rotatably driven loop taker casing having an axis of rotation generally parallel to the vertically extending needle bar, the casing providing a discontinuous annularly extending surface constituting a discontinuous circular race extending about the casing axis of rotation, the center of the circular race being eccentrically offset from the casing axis of rotation;

a pair of diametrically opposed stop members generally fixed in position relative to the loop taker axis of rotation, the stop members bracketing the loop taker axis of rotation, the distance between each stop member and said axis being equal;

a non-rotatable bobbin carrier slidably supported on the eccentrically offset circular race, rotation of the loop taker casing relative to the non-rotatable eccentrically positioned bobbin carrier causing reciprocating planar movement of the bobbin carrier into engagement against one and then the other of the fixed stops, the stops cooperating to preclude rotation of the bobbin carrier, the bobbin carrier alternately disengaging from one and then the other of the stops to permit free passage of a thread loop about the bobbin carrier between the stops and the bobbin carrier, at least one or the other of the stops always engaging the bobbin carrier when the loop taker casing is rotating, the bobbin carrier planar movement being in a plane perpendicular to said axis of rotation, the bobbin carrier being disc-like and providing a circularly extending periphery slidably supported by said circular race, said casing being cup-shaped and having an upper lip portion, the circular race being constituted by the upper lip portion of the cup-shaped casing, the bobbin carrier being nested within and spaced from the bottom of the cup-shaped casing, said lip portion being slidably received within and projecting into a discontinuous slot about the circularly extending periphery of the disc-like bobbin casing, the bobbin carrier being retained in its nested position within the loop taker casing, the disc-shaped bobbin carrier comprising a top half member and a bottom half member, the members being spring-biased against each other at their peripheries to sandwich said lip portion between them, the members being movable away from each other to a limited degree to permit sliding of the rotatable lip portion relative to the members at a predetermined degree of friction between the lip portion and the members.

10. In a sewing machine having a vertically extending needle bar, a loop taker mechanism comprising:

a rotatably driven loop taker casing having an axis of rotation generally parallel to the vertically extending needle bar, the casing providing a discontinuous annularly extending surface constituting a discontinuous circular race extending about the casing axis of rotation, the center of the circular race being eccentrically offset from the casing axis of rotation;

a pair of diametrically opposed stop members generally fixed in position relative to the loop taker axis of rotation, the stop members bracketing the loop taker axis of rotation, the distance between each stop member and said axis being equal;

a non-rotatable bobbin carrier slidably supported on the eccentrically offset circular race, rotation of the loop taker casing relative to the non-rotatable eccentrically positioned bobbin carrier causing reciprocating planar movement of the bobbin carrier into engagement against one and then the other of the fixed stops, the stops cooperating to preclude rotation of the bobbin carrier, the bobbin carrier alternately disengaging from one and then the other of the stops to permit free passage of a thread loop about the bobbin carrier between the stops and the bobbin carrier, at least one or the other of the stops always engaging the bobbin carrier when the loop taker casing is rotating, the bobbin carrier planar movement being in a plane perpendicular to said axis of rotation, said loop taker mechanism including a cam surface on each of said stops, wherein during engagement with and movement against each one of said stops the bobbin carrier contacts said cam surface and pivots about said engaged stop to pivotally move the bobbin carrier out of engagement with the other stop to permit free passage of a thread loop between the other stops and the bobbin carrier.

11. A loop taker mechanism according to claim 10, wherein the bobbin carrier pivots about each of said stops in like rotational directions.

12. A loop taker mechanism according to claim 11, wherein the stops project into recesses of the bobbin carrier.

13. In a sewing machine having a vertically extending needle bar, a loop taker mechanism comprising:

a rotatable loop taker drive shaft having a vertical axis of rotation parallel to the vertically extending needle bar, the lower end of the shaft providing gear means for engagement with a drive means;

a cup-shaped loop taker casing concentrically mounted on the top end face of the drive shaft, the casing having at its upper end an inwardly radially extending discontinuous lip lying in an annular area whose center is eccentrically offset from the drive shaft axis of rotation, the lip constituting a discontinuous eccentrically positioned circular race;

a disc-shaped, non-rotatable bobbin carrier nested within and spaced from the bottom of the cup-shaped loop taker casing, the bobbin carrier having a circularly extending periphery slidably supported on the eccentrically offset race wherein rotation of the loop taker casing relative to the non-rotatable eccentrically positioned bobbin carrier causes reciprocating movement of the bobbin carrier;

a stop plate overlying the peripheral portions of the loop taker casing and the bobbin carrier, the stop plate being fixed in position relative to the drive shaft axis of rotation, the stop plate providing a pair of stop projections diametrically opposed relative to the drive shaft axis of rotation, the stop projections extending into recesses on the upper face of the bobbin carrier, a pair of shoulder portions defining a portion of said recesses being engageable with an associated pair of cam surfaces carried by said stop projection, rotation of the loop taker casing relative to the eccentrically positioned bobbin carrier reciprocating movement of said bobbin carrier shoulder portions into engagement against one and then the other of the cam surfaces, the fixed cam surfaces cooperating to preclude rotation of the bobbin carrier, the cam surfaces alternately disengaging from their respective bobbin carrier shoulder portions to permit free passage of a thread loop about the bobbin carrier between the cam surfaces and the shoulder portions, at least one or the other of the cam surfaces always engaging a shoulder portion when the loop taker casing is rotating, the bobbin carrier pivoting about each cam surface during the period of engagement with it, the non-engaged shoulder pivotally moving away from the associated cam surface to permit free passage of the thread loop.

14. A loop taker mechanism according to claim 13, wherein the cam surfaces extend along parallel lines, the lines being spaced from the loop taker axis of rotation which lies between the lines.

* * * * *